US009463950B2

(12) United States Patent
Yu Chen

(10) Patent No.: US 9,463,950 B2
(45) Date of Patent: Oct. 11, 2016

(54) TAPE HOLDING WHEEL FOR A TAPE DISPENSER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 14/683,717

(22) Filed: Apr. 10, 2015

(65) Prior Publication Data

US 2015/0210504 A1 Jul. 30, 2015

Related U.S. Application Data

(63) Continuation-in-part of application No. 13/644,611, filed on Oct. 4, 2012, now abandoned.

(51) Int. Cl.
*B65H 35/00* (2006.01)
*B65H 75/18* (2006.01)

(52) U.S. Cl.
CPC ..... *B65H 75/185* (2013.01); *B65H 35/0033* (2013.01); *B65H 35/0073* (2013.01); *Y10T 156/17* (2015.01)

(58) Field of Classification Search
CPC ..... B65H 35/002; B65H 35/0033; B65H 37/005; B65H 75/185
See application file for complete search history.

(56) References Cited

U.S. PATENT DOCUMENTS

| | | | | |
|---|---|---|---|---|
| 3,753,839 | A * | 8/1973 | Funke | B65H 35/0033 156/527 |
| D453,355 | S * | 2/2002 | Potter | D19/69 |
| 7,669,631 | B2 * | 3/2010 | Bailey | B65H 35/0033 156/523 |
| 2007/0125475 | A1 * | 6/2007 | Cecilio | B65H 35/0033 156/71 |
| 2011/0272103 | A1 * | 11/2011 | Mazzucchelli | B65H 35/0026 156/510 |

* cited by examiner

*Primary Examiner* — Mark A Osele
(74) *Attorney, Agent, or Firm* — Ming Chow; Sinorica, LLC

(57) ABSTRACT

A tape holding wheel for a tape dispenser suitable for tape rolls of different size comprises a first engaging unit, and a second engaging unit. There are plurality of supporting ribs which protrudes from an external cambered surface of the tape holding wheel. A propping part is integrally and laterally formed and extended from a top end of each supporting rib, and a propping rib is axially extended on an external end of the propping part. The engaging units are disposed on the tape holding wheel for engaging with a sleeve of the tape dispenser firmly.

5 Claims, 12 Drawing Sheets

TAPE HOLDING WHEEL FOR A TAPE DISPENSER

CROSS REFERENCE TO RELATED APPLICATION

This application is a continuation-in-part of U.S. patent application Ser. No. 13/644,611 filed on Oct. 2, 2014. The content of the above-referenced application is incorporated by reference herein.

FIELD OF THE INVENTION

The present invention relates to a tape holding wheel for a tape dispenser, especially to a tape holding wheel that can firmly cooperate with a tape tube on a tape dispenser.

BRIEF DESCRIPTION OF THE PRIOR ART

A conventional tape dispenser mainly includes a tape holding wheel to cooperate with a tape roll so that the tape will be dispensed from the tape holding wheel and used in a packaging process. However, there are many different types of tape which are in different size. The central diameters of the conventional tape tubes of the tape rolls are also different. Therefore, the tape holding wheel for the tape dispenser is provided to allow most tapes of tape to be fitted in a tape dispenser. The tape holding wheel is an adjustable one and suitable for tapes of various sizes.

Referring to FIG. 1, which shows a perspective exploded view of a conventional tape holding wheel for a tape dispenser, there is a tape holding wheel 320 adopted on a tape dispenser 300. The tape dispenser 300 mainly includes a vertical plate 303, a sleeve 305 axially placed over a fixing post, a plurality of parallel arranged protrusion rails 306 being formed on a circumference of the sleeve 305. The rails 306 are parallel to a central axle of the sleeve 305 so that the tape holding wheel 320 can be axially engaged with the sleeve 305 for a synchronize rotation. There is a slot 314 provided on a front portion of the sleeve 305. An axial opening 321 is formed in the center of the tape holding wheel 320 with a plurality of parallel sliding groves 322 formed on the inner surface of the axial opening 321. These sliding grooves 322 are formed to match and correspond to the protrusion rails 306. A buckle 323 is formed on the tape holding wheel 320 and downwardly protruded from a rear end of the tape holding wheel 320. This buckle 323 may cooperate with the slot 314 and tightly fitted into the slot 314. This arrangement and mechanism allows a tape roll to be conveniently changed.

Referring to FIG. 2, which shows a perspective exploded view of a second conventional tape holding wheel for a tape dispenser, the dispenser 400 is mainly in the same structure of the dispenser 300 shown in FIG. 1. The dispenser 400 includes a second vertical plate 403 and a second sleeve 405. A plurality of protrusion rails 406 are formed parallel on the circumference of the second sleeve 405. A central hoe 421 is formed in the tape holding wheel 420 with a plurality of sliding grooves 422 formed on the inner surface of the central hole of the tape holding wheel 420. The difference are a crook 407 is protrudently installed on a front end of the sleeve 405, and a plurality of notches 423 being formed on an inner circumference of a front end of the tape holding wheel 420. Thereby, the crook 407 of the sleeve 405 can be fitted tightly in the notch 423 for a convenient tape rolls replacement.

Although the conventional tape holding wheels can be cooperated with the tape dispenser for holding various type of tape rolls, the structure of aforementioned two conventional types of tape holding wheels are quite different. Therefore, different type of tape holding wheels has to be chosen and used to cooperate with these two different tape dispensers. Accordingly, it is inconvenient for users to replace the tape holding wheel in different types of tape dispensers. Moreover, the manufacturing cost of the tape holding wheel is relatively high. Thus, the present invention is to provide a tape holding wheel that can be suited to different kinds of tape dispensers for achieving a convenient assemblage and decreasing the manufacturing cost.

SUMMARY OF THE INVENTION

It is therefore the principle objective of the present invention is to provide a tape holding wheel that can be used with different kind of tape dispensers for achieving the goal of a convenient assemblage and decrease the manufacturing cost.

The characteristics of the tape holding wheel for a tape dispenser according to the present invention are described herein below. The tape holding wheel has an axial opening defined at a center portion thereof and a plurality of parallel sliding grooves provided on an inner wall of the tape holding wheel being arranged correspondingly to the rails of a sleeve of the tape dispenser. The tape holding wheel will be moved synchronized by and with sleeve. A plurality of lengthwise supporting ribs are protruded on an external cambered surface of the tape holding wheel and parallel to an axle thereof. A propping part is integrally and laterally extended from a top end of each supporting rib, toward a direction to the external cambered surface of the tape holding wheel. The propping part has a propping rib being axially extended on an external end of the propping part and a guiding ramp is formed on an introducing point of the propping rib. A blocking end is outward extended from an end of the propping part, a first engaging unit is disposed on a front end of the tape holding wheel for the sleeve to firmly cooperate with the tape holding wheel, and a second engaging unit is disposed on a rear end of the tape holding wheel for the sleeve to firmly cooperate with the tape holding wheel. By means of the engaging units, the sleeve of the tape dispenser and the tape holding wheel can be engaged firmly.

Accordingly, the tape holding wheel for the tape dispenser of the present invention achieves the goal of convenient assemblage, decreasing the need of manufacturing materials, and reducing manufacturing costs.

DETAILED DESCRIPTION OF THE PREFERRED EMBODIMENTS

Figure 1:
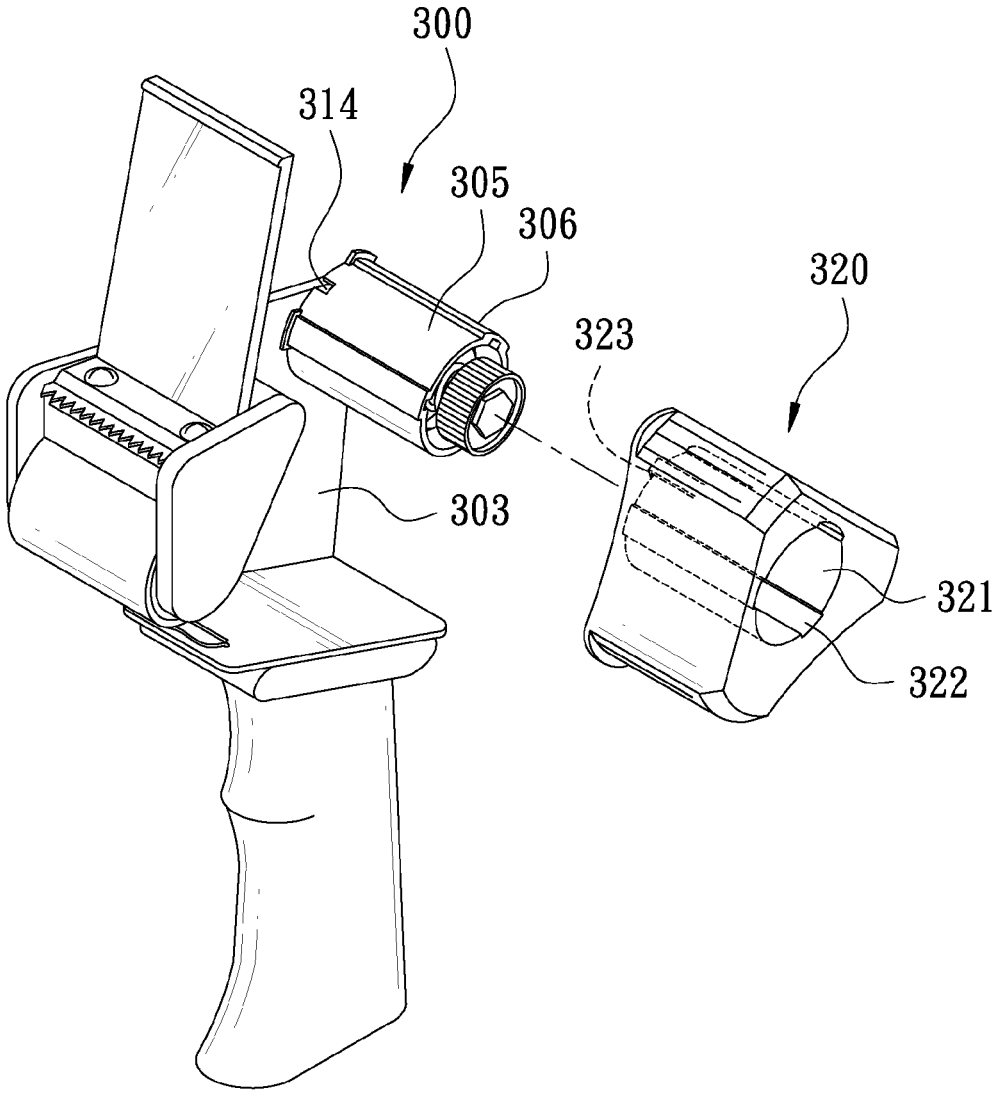
FIG. 1 PRIOR ART
FIG. 1 is an exploded view of a conventional tape dispenser and a conventional tape holding wheel.
Figure 2:
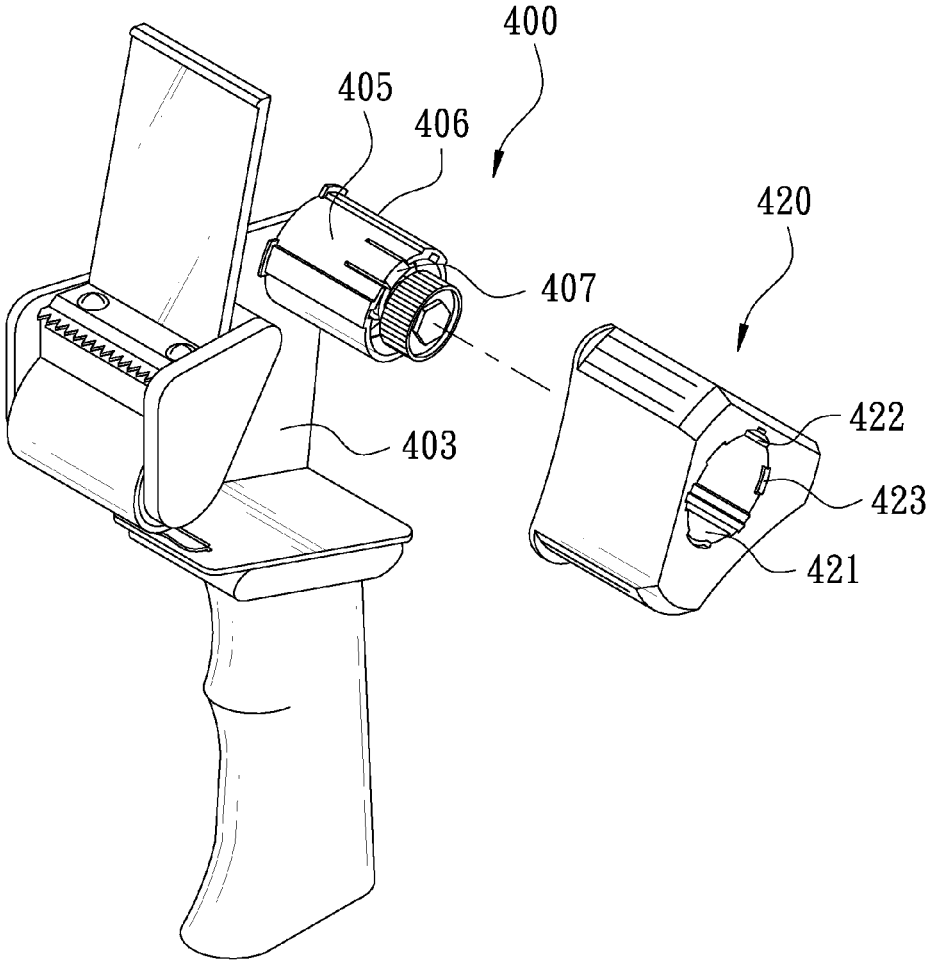
FIG. 2 PRIOR ART
FIG. 2 is an exploded view of another conventional tape dispenser and tape holding wheel.
Figure 3:
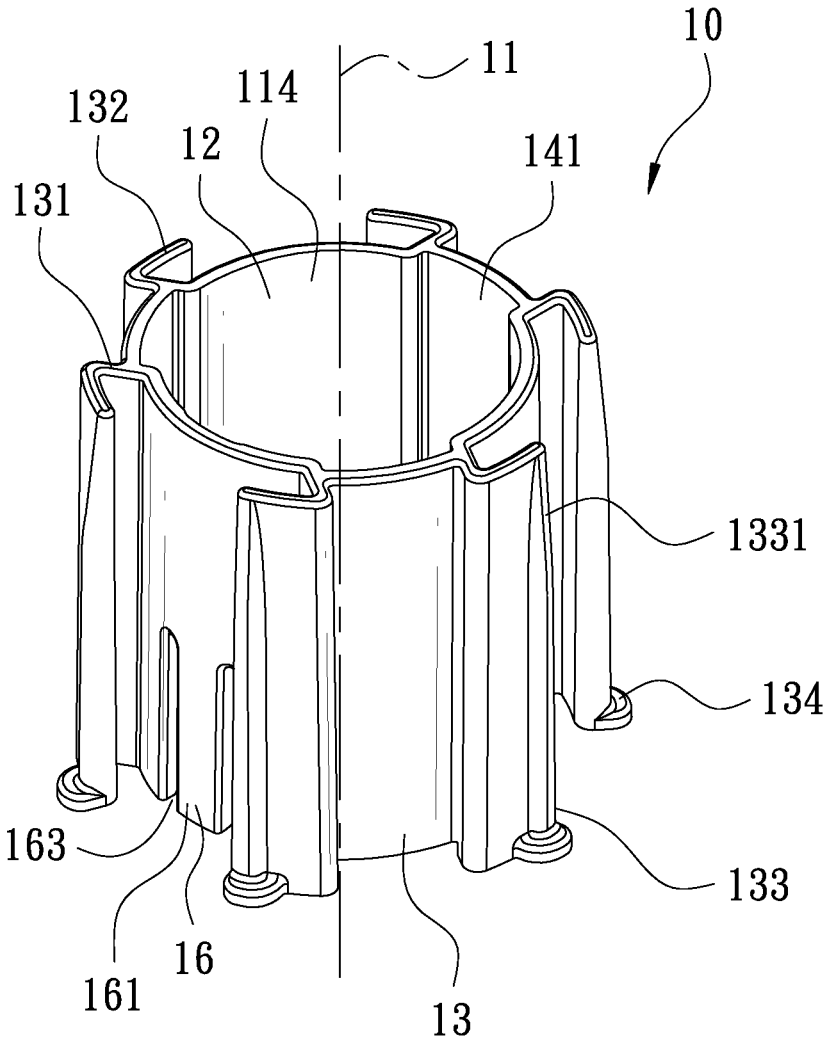
FIG. 3 is a perspective view of a tape holding wheel according to a first embodiment of the present invention.
Figure 4:
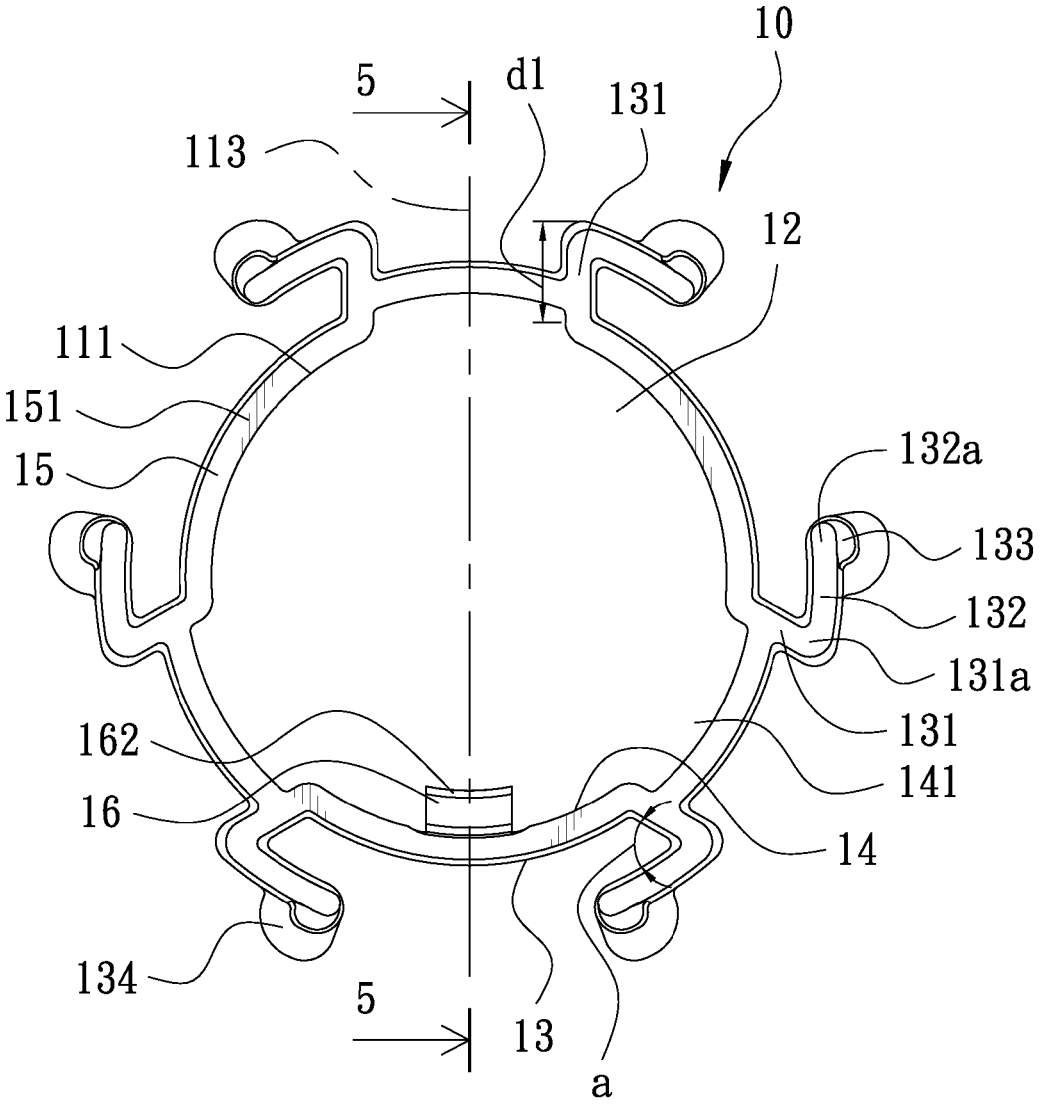
FIG. 4 is a top view of a tape holding wheel according to the first embodiment of the present invention.
Figure 5:
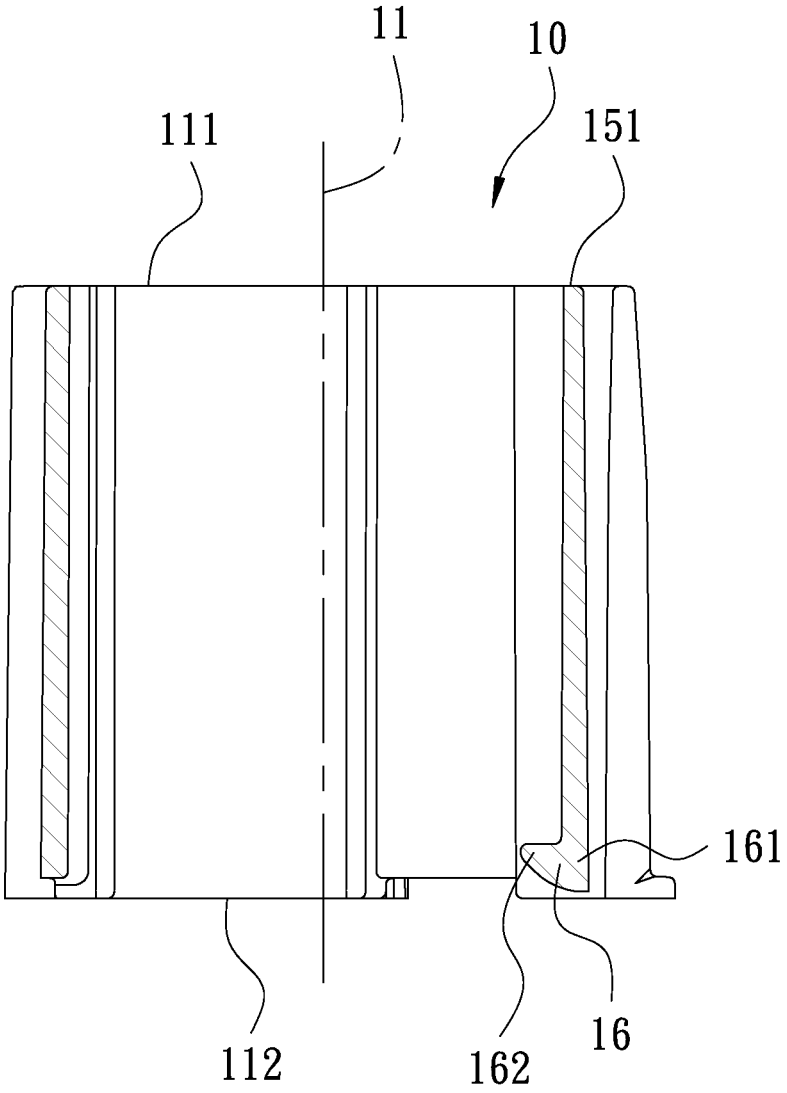
FIG. 5 is a cross-sectional view of the first embodiment of a tape holding wheel along the section line 5-5 in FIG. 4.

Referring conjunctively to FIGS. 3, 4, and 5 which show a perspective view, a top view, and a cross-sectional view of section 5-5 in FIG. 4 of the tape holding wheel according to the present invention. A tape holding wheel 10 has an axis 11 in the center portion thereof. Along the two ends of the axis 11 of the tape holding wheel 10, there are a first end surface 111 and a second end surface 112. The tape holding wheel 10 also comprises an axial opening 12 causing the tape holding wheel to have an external cambered surface 13 and an inner surface 14. A plurality of parallel sliding grooves 141 are depressed and formed on the inner surface 14 of the tape holding wheel 10 and the sliding grooves 141 are also parallel to the axis 11 of the tape holding wheel 10. A plurality of lengthwise supporting ribs 131 are protruded on an external cambered surface of the tape holding wheel 10 which are also parallel to the sectional axis 113 of the holding wheel. The supporting ribs 131 are protruded from the external circumference of the tape holding wheel 10, corresponding to two sides of the sliding grooves 141. Each of the supporting ribs 131 has a predetermined height d1 as shown in FIG. 4. Each of the supporting ribs 131 has a free end 131*a* and an arc-shaped propping part 132 is integrally and laterally extended from the free end 131*a* of each supporting rib 131 toward a direction to the external cambered surface 13 of the tape holding wheel 10. There is an angle "a" formed with the propping part 132 and the supporting rib 131. The angle "a" is less than 90 degrees. The propping part 132 has a free end 132*a* with a propping rib 133 formed. One end of the propping parts 132 is suspended from the external cambered surface 13 of the tape holding wheel 10. Moreover, the propping parts 132 are facing with each other, and extended from top ends of the supporting ribs 131, toward a direction to a middle portion between two sliding grooves 141. A propping rib 133 is axially extended on an external end of the propping part 132 and has a guiding ramp 1331 formed facing the first end surface 111. The guiding ramp 1331 is formed on an introducing point of the propping rib 133 for the tape tube to smoothly travel. Each propping rib 131 has a top end formed into an arc shape for tightly stopping an inner wall of the tape tube. A blocking end 134 is outward extended from one end of the propping part 132. The tape holding wheel 10 also includes a first engaging unit 15 and a second engaging unit 16. The first engaging unit 15 comprises a contacting part 151 which is formed on the front end of the tape holding wheel 10 and perpendicular to the axial 11. The second engaging unit 16 is formed on the inner surface 14 which comprises a reversed hook 161 having a hook ear 162 stretching inwardly from the rear end of the tape holding wheel 10. At two sides of the reversed hook 161, there are formed two ripped grooves 163 parallel to the axial 11.

Figure 6:
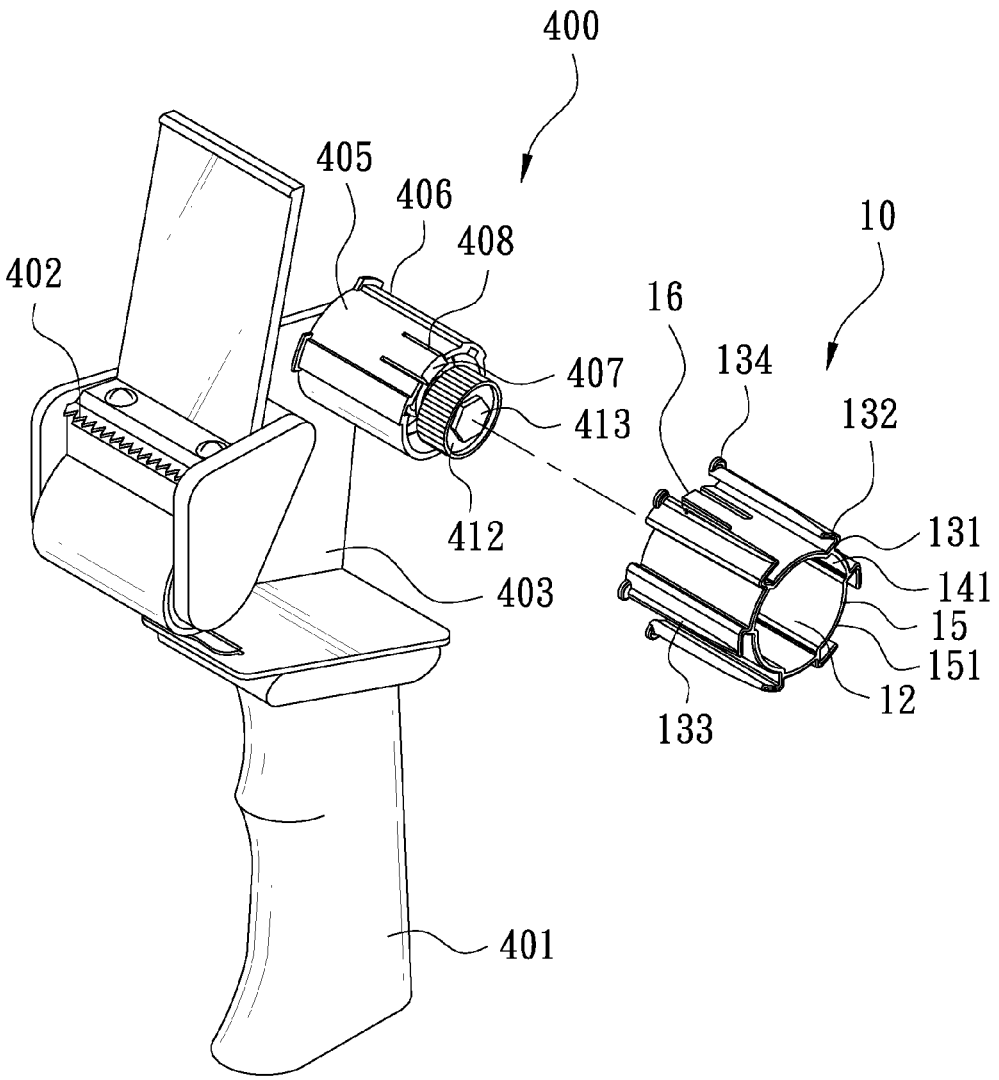
FIG. 6 is an exploded view of a first preferred embodiment of the tape holding wheel according to the present invention to be used with a tape dispenser.

Referring to FIG. 6, a perspective view of a first preferred embodiment of the tape holding wheel according to the present invention is shown. The tape holding wheel 10, in cooperating with a tape dispenser 400, is able to assist various tape rolls to be used or replaced. The tape dispenser 400 includes a handle 401 for users to operate, a saw 402 for cutting the tape, a vertical board 403 fixed on one side of the handle 401, a fixing post 404 perpendicularly disposed on the vertical board 403, a sleeve 405 placed over the fixing post 404, and a plurality of rails 406 parallelly protruded on an external circumference of the sleeve 405 and also parallel to an axle of the sleeve 405. The rails 406 allow a tape roll of a small size to be axially engaged thereto. Further, the sliding grooves 141 of the tape holding wheel 10 are correspondingly disposed to the rails 406 on the sleeve 405 and thus thereby allow the tape holding wheel 10 and the sleeve 405 to be axially engaged and synchronized in movement. An outward crook 407 is protruded from a front end of the sleeve 405. Two ripped grooves 408 in a predetermined length are formed on two sides of the crook 407, respectively. A hook part 407*a* of the crook 407 stretches out from an external part of the sleeve 405 and corresponding to the contacting part 151, thereby allowing the sleeve 405 and the tape holding wheel 10 to be firmly engaged with each other.

Figure 7:
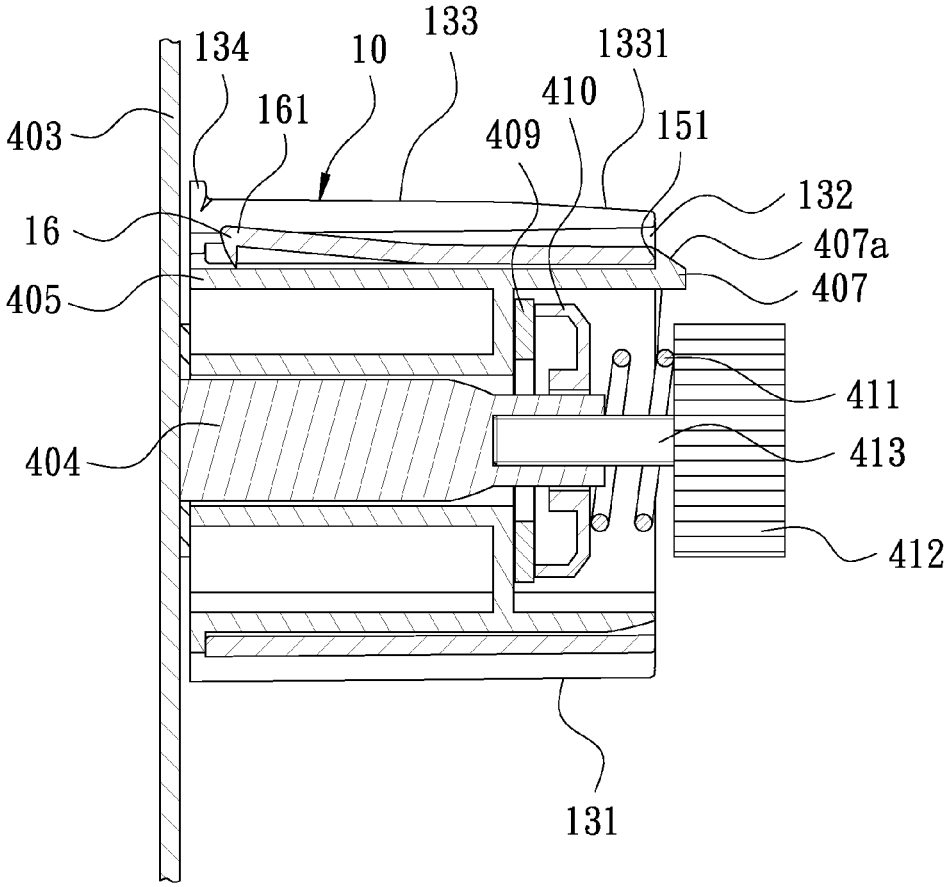
FIG. 7 is a partially cross-sectional view of the first preferred embodiment of the tape holding wheel according to the present invention being assembled and used with a tape dispenser.
Figure 8:
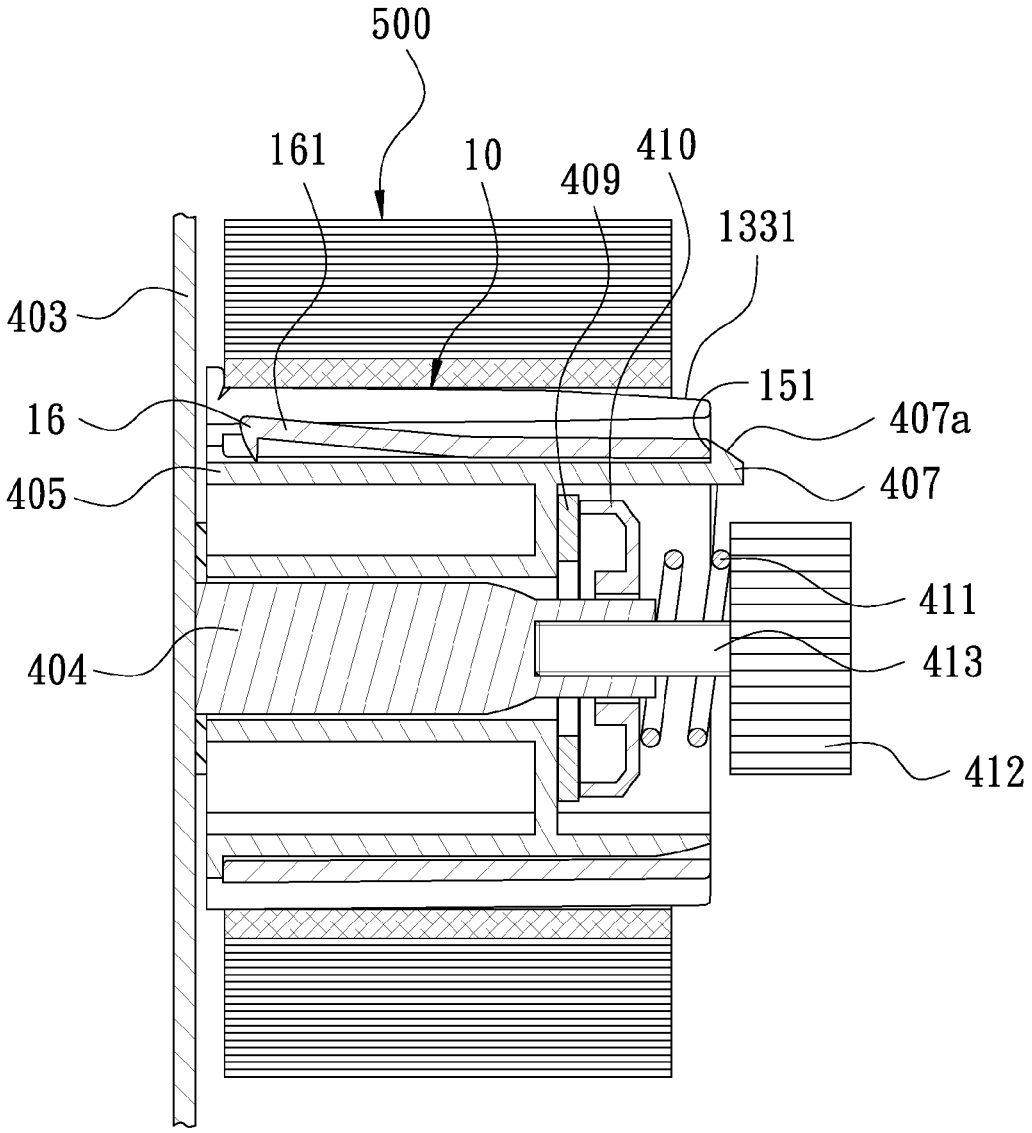
FIG. 8 is a sectional illustrative view of a tape roll being adopted on a tape holding wheel of the first preferred embodiment according to the present invention where the supporting rib having a first height.
Figure 9:
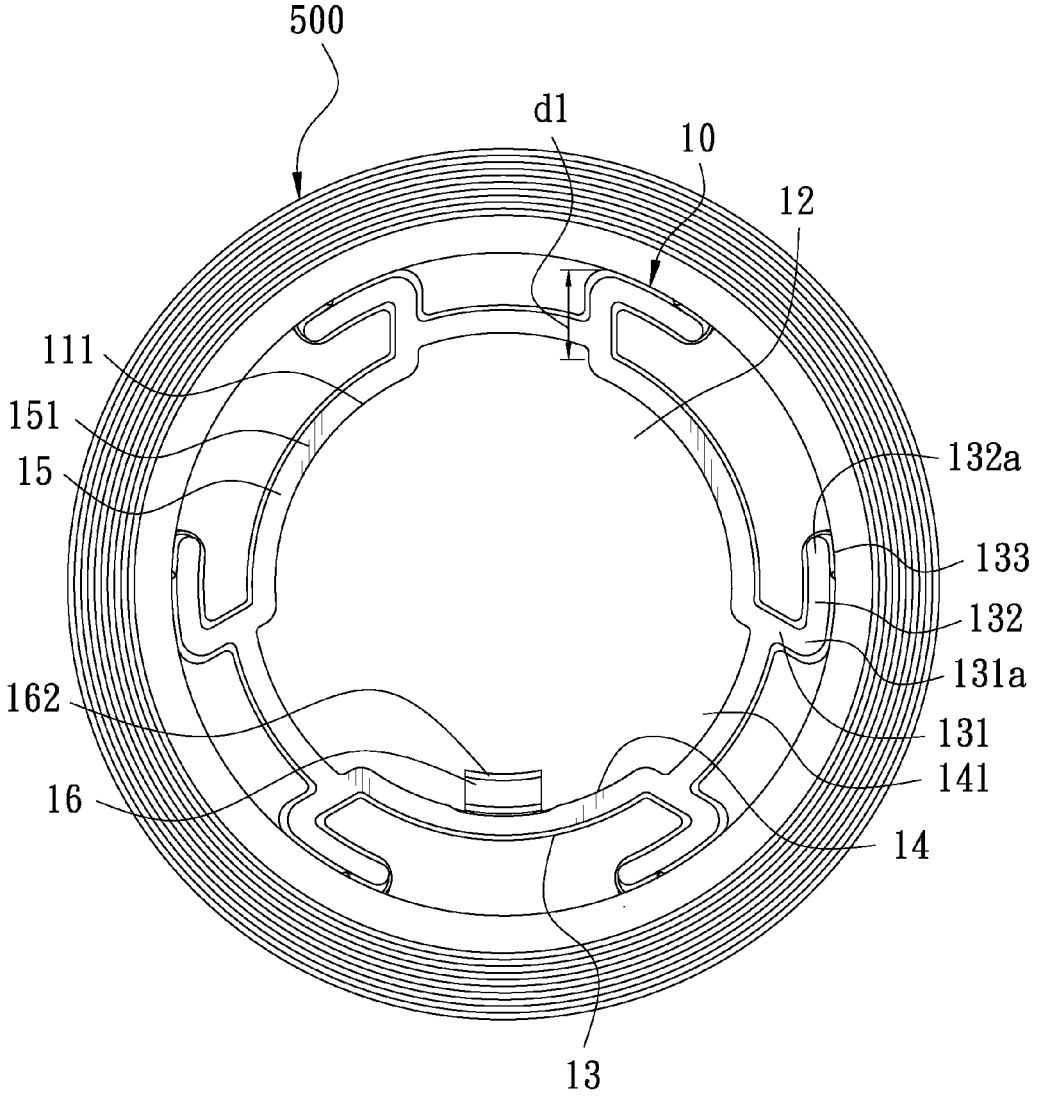
FIG. 9 is a another illustrative sectional view of a tape roll adopted on a first embodiment of a tape holding wheel according to the present invention.

In assembly, the sleeve 405 is placed over the fixing post 404 of the tape dispenser 400. A spacer 409, a fixing seat 410, and a spring 411 are cooperatively installed into the fixing post 404. A cover 412 and a screw 413 help the fixing post 404 and the sleeve 405 to be fixed with each other. Thus, a small diameter tape roll can be stored on the tape holding wheel 10 for intended use. For installing the tape holding wheel 10, the sliding grooves 141 of the tape holding wheel 10 are aligned toward the rails 406 on the sleeve 405, so that the tape holding wheel 10 is engaged with the sleeve 405. Accordingly, the hook part 407*a* of the crook 407 of the sleeve 405 will firmly fasten the contacting part 151 of the tape holding wheel 10 as that shown in FIG. 7.

When user likes to use the tape, the tape roll is first installed on the tape holding wheel 10. The guiding ramp 1331 allows the tape roll to be placed smoothly. Moreover, because the propping ribs 133 are slightly protruding from the propping parts 132, therefore the propping ribs 133 will be radially pressed by the moving tape roll accordingly. Thereafter, the tape roll continues to move until it touches the blocking end 134. In the meantime, the tape roll will stop traveling and the propping ribs 133 deform and provide elastic bounce to tightly hold the tape roll. Accordingly, users are able to release the tape or conduct a packaging by suing the tape dispenser 400.

Therefore, with the structure of propping ribs 131 being parallel to the sectional axle 113, the propping parts 132 being parallel to the external cambered surface 13 and the free end 132*a* of the propping parts 132 having propping ribs 133, the propping ribs 133 will push against the tape roll 500 to smoothly the use the tape dispenser. Also, since the angle "a" is less than 90 degrees, the extent of deformation of the propping parts 132 and the propping ribs is very much limited thus to result a mechanical strength of the entire tape dispenser.

When the tape holding wheel 10 is placed over the sleeve 405, the hook ear 162 of the reversed hook 161 is slightly protruding out from the inner surface 14 of the tape holding wheel 10. In the meantime, the reversed hook 18 is also radially pressed by the sleeve 405. Two ripped grooves 163, in a predetermined length, are formed on two sides of the reversed hook 18, respectively. The ripped grooves 163 prevent the reversed hook 18 from over-deforming and thus avoiding the same to be damaged.

Figure 10:
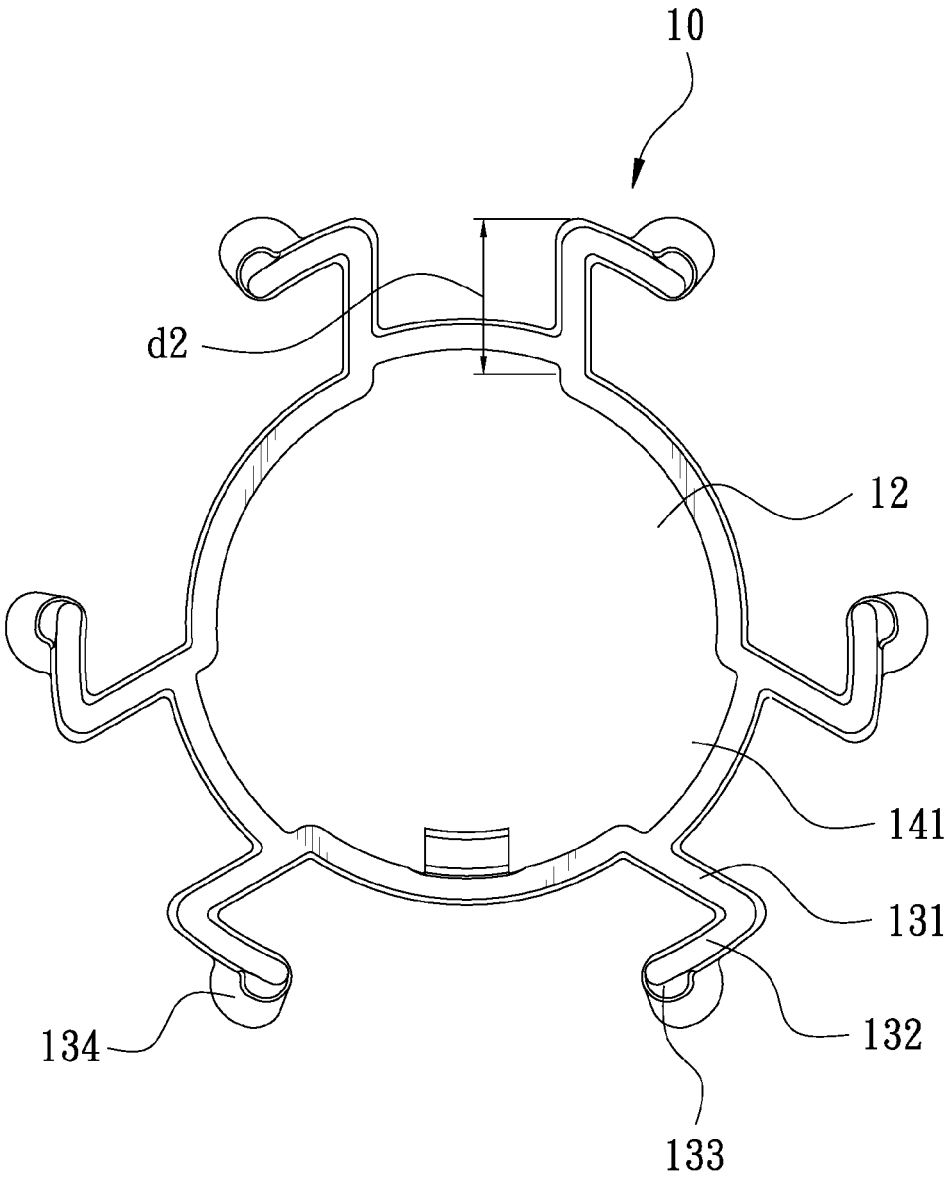
FIG. 10 is a sectional view of a supporting rib of the tape holding wheel having a second height.

When different sizes of the tape rolls are to be applied, the crook 407 on the sleeve 405 is pressed, so that hook part 407*a* of the crook 407 departs from the contacting part 151, and the tape holding wheel 10 can be removed away from the tape dispenser. Referring to FIG. 10, the supporting ribs 131 on the tape holding wheel 10 have another predetermined height d2 for being engaged with a different type of tape roll. With the structure and mechanism of the tape holding wheel according to the present invention will allow various tape rolls of different sizes to be replaced efficiently.

Additionally, since the propping parts 132 are formed into an arc shape, it allows the tape roll to contact the propping parts 132 smoothly. The arc on the propping parts 132 also prevents the tape roll from deformation during releasing the tape or packaging. Therefore, the tape dispenser 500 releases the tape for packaging efficiently and smoothly. When the free end 132*a* of the propping parts 132 are suspended from the external cambered surface 13 of the tape holding wheel 10, the propping parts 132 are axially pressed to become deformation for contacting the tape roll firmly. Apparently one can tell that the tape holding wheel 10 of the present invention needs less manufacturing material and hence decreases related manufacturing cost.

Figure 11:
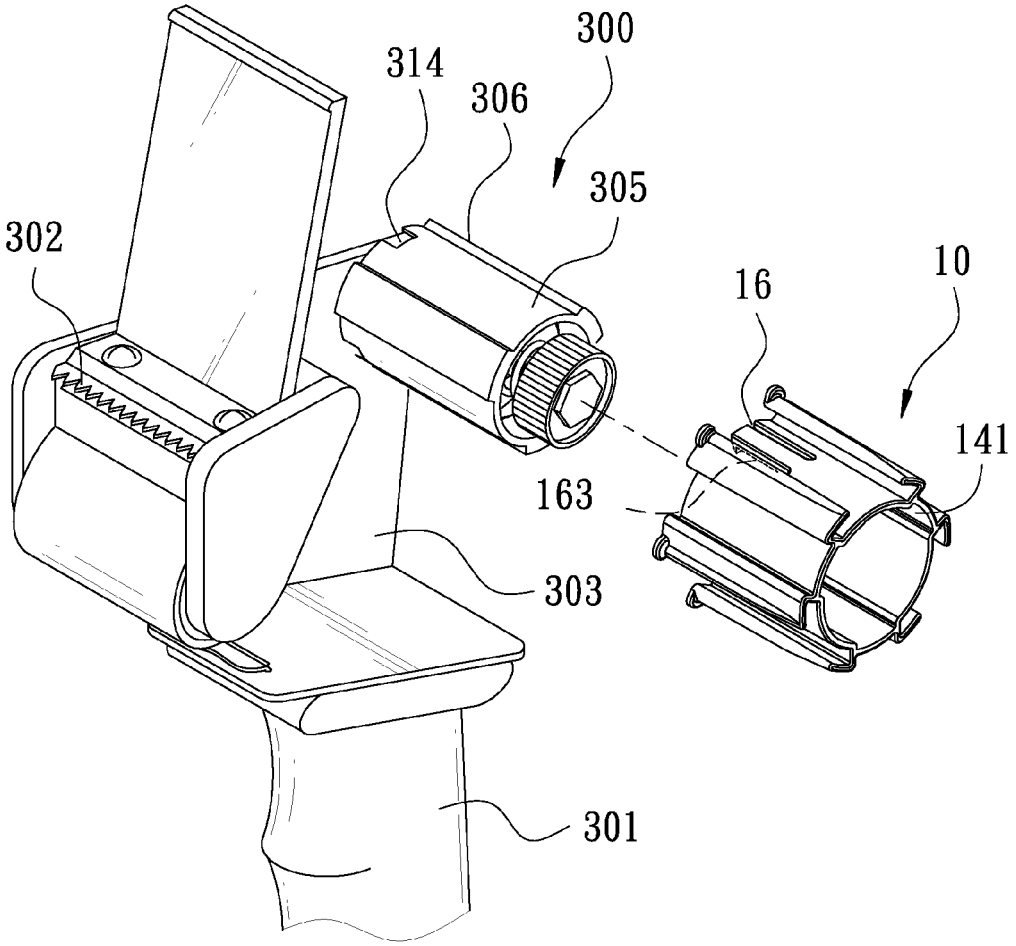
FIG. 11 is an exploded view of a second preferred embodiment of the tape holding wheel according to the present invention to be used with a tape dispenser.
Figure 12:
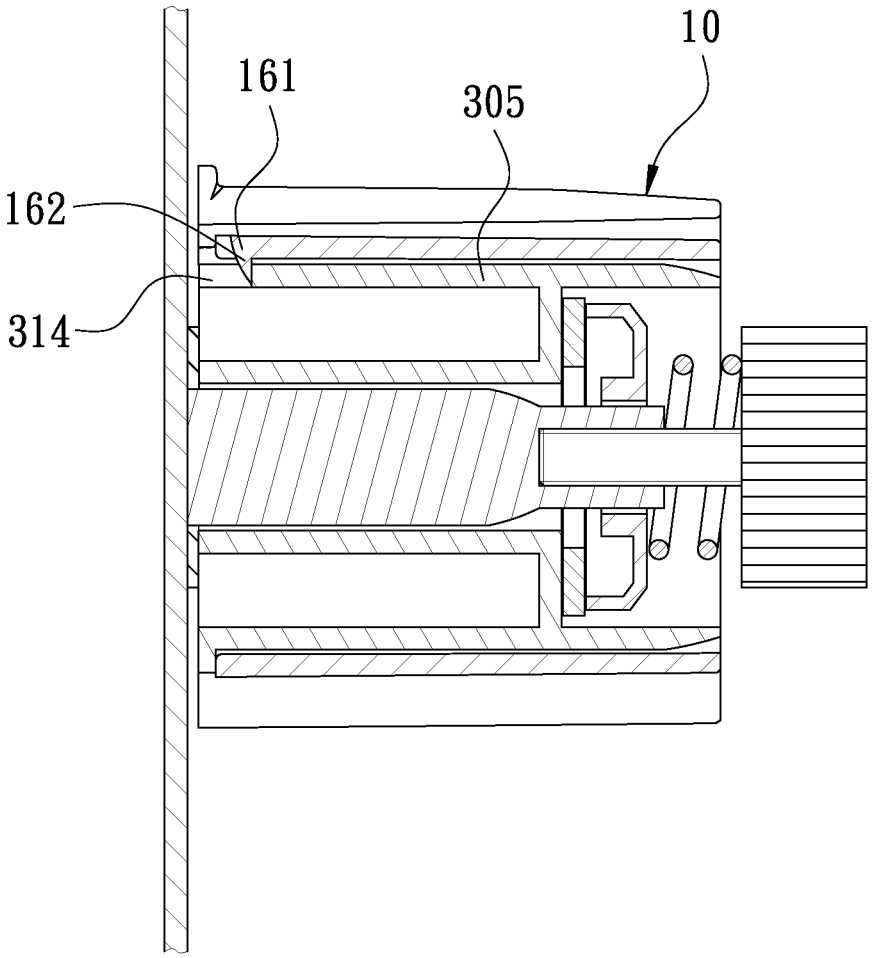
FIG. 12 is a partially cross-sectional view of the second preferred embodiment of the tape holding wheel according to the present invention being assembled and used with a tape dispenser

FIGS. 11 and 12 show exploded view and a partial cross-sectional view of a second preferred embodiment of the tape holding wheel according to the present invention. The tape dispenser 300 applied in the second preferred embodiment is similar to that of afore described first preferred embodiment. The tape dispenser 300 includes a handle 301 for users to operate, a saw 302 for cutting the tape, a vertical board 303 fixed on one side of the handle 301, a fixing post 304 perpendicularly disposed on the vertical board 303, a sleeve 305 placed over the fixing post 304, and a plurality of rails 306 parallel protruded on an external circumference of the sleeve 305 and also parallel to an axle of the sleeve 305. The rails 306 allow a tape roll of a small size. Differently, there is least one slot 314 which being depressed on the fore part of the sleeve 305 corresponding to the reversed hook 161. In this embodiment, there are three slots 314, and the slots 314 help the sleeve 305 and the tape holding wheel 10 to be firmly engaged with each other.

During assemble of the tape holding wheel 10, the sliding slots 141 are aimed toward the rails 306 on the sleeve 305, so that the tape holding wheel 10 is placed over the sleeve 305. Accordingly, the reversed hook 161 is able to suitably slide into the slots 314 on the sleeve 305 as shown in FIG. 11 to complete the assemble of the second preferred embodiment of the tape holding wheel.

When tape rolls of different sizes are to be applied, one can pull the reversed hook 161 oppositely to release the engagement between the reversed hook 161 and the slot 314. The ripped grooves 163 at two sides of the reversed hook 161 assists users in conveniently pulling the reversed hook 161.

Although the tape holding wheel for a tape dispenser according to the present invention has been described hereinabove of preferred embodiments, it is to be understood that other changes and modifications can be made without departing from the spirit of the present invention and shall fall within the scope of the appended claims.

What is claimed is:

1. A tape holding wheel for a tape dispenser comprising:

a wheel body with an axis, having a first end surface and a second end surface, an inner surface and an external cambered surface, a plurality of sliding grooves formed on said inner surface, a plurality of supporting ribs formed on said external cambered surface, each of said supporting ribs having a free end extended to become a propping part comprising a propping rib, said propping rib comprises a guiding ramp facing said first end surface, said propping part comprising a blocking end toward said second end surface;

a first engaging unit formed on said first end surface of said wheel body and between two adjacent of said sliding grooves; and a second engaging unit formed on said second end surface approximate to said inner surface.

2. A tape holding wheel as claimed in claim 1 wherein said first engaging unit comprises a contacting part which is parallel to said axis of said wheel body.

3. A tape holding wheel as claimed in claim 2 wherein said second engaging unit comprises a reversed hook which further comprises a hook ear protruding from said inner surface and a pair of ripped grooves with predetermined length formed at two sides of said reversed hook.

4. A tape holding wheel as claimed in claim 1 wherein said supporting ribs of said wheel body are formed at two sides of said sliding grooves of said wheel body.

5. A tape holding wheel as claimed in claim 1 wherein said propping part and said supporting rib are formed to define an angle which is less than ninety degrees.

* * * * *